310-369 SR
PTU11 XR 4,038,348

United States Patent [19]
Kompanek

[11] 4,038,348
[45] July 26, 1977

[54] ULTRASONIC SYSTEM FOR IMPROVED COMBUSTION, EMISSION CONTROL AND FUEL ECONOMY ON INTERNAL COMBUSTION ENGINES

[76] Inventor: Harry W. Kompanek, 153 Rametto Road, Santa Barbara, Calif. 93108

[21] Appl. No.: 582,205

[22] Filed: May 30, 1975

Related U.S. Application Data

[63] Continuation-in-part of Ser. No. 344,534, March 26, 1973, abandoned.

[51] Int. Cl.[2] ..... F02M 27/08

[52] U.S. Cl. ..... 261/36 A; 261/81; 261/DIG. 48; 239/102; 123/198 E

[58] Field of Search ..... 340/10, 11; 123/198 E; 261/DIG. 48, 1, 81, 36 A; 239/102

[56] References Cited

U.S. PATENT DOCUMENTS

| | | | |
|---|---|---|---|
| 1,939,302 | 12/1933 | Heaney | 261/DIG. 48 |
| 2,704,535 | 3/1955 | Magui et al. | 261/DIG. 48 |
| 2,779,623 | 1/1957 | Eisenkraft | 261/DIG. 48 |
| 2,791,990 | 5/1957 | Grieb | 261/DIG. 48 |
| 2,907,648 | 10/1959 | Chapman | 261/DIG. 48 |
| 2,971,994 | 5/1957 | Grieb | 261/DIG. 48 |
| 3,016,233 | 1/1962 | Olmstead | 261/DIG. 48 |
| 3,155,141 | 11/1964 | Doyle et al. | 261/DIG. 48 |
| 3,284,762 | 11/1966 | Kompanek | 261/DIG. 48 |
| 3,357,641 | 12/1967 | Martner | 261/DIG. 48 |
| 3,392,916 | 7/1968 | Engstrom et al. | 261/DIG. 48 |
| 3,533,606 | 10/1970 | Thatcher | 261/DIG. 48 |

FOREIGN PATENT DOCUMENTS

| | | | |
|---|---|---|---|
| 17485/70 | 6/1966 | Japan | 261/DIG. 48 |
| 723,797 | 2/1955 | United Kingdom | 261/DIG. 48 |

OTHER PUBLICATIONS

Popular Science, Mar. 1973, "Ultrasonic Fuel Systems", Norbye, pp. 89, et. seq.

*Primary Examiner*—Tim R. Miles
*Attorney, Agent, or Firm*—Wills, Green & Mueth

[57] ABSTRACT

A novel system for use on internal combustion engines comprising:

a. a cylindrical transducer adapted to vibrate primarily in the hoop or radial mode,
b. electrical means for powering said transducer, and
c. means for contacting a stream of liquid internal combustion engine fuel with a vibrating surface of said transducer whereby said fuel is effectively atomized or vaporized.

17 Claims, 5 Drawing Figures

ULTRASONIC SYSTEM FOR IMPROVED COMBUSTION, EMISSION CONTROL AND FUEL ECONOMY ON INTERNAL COMBUSTION ENGINES

This application is a continuation-in-part of Ser. No. 344,534, filed Mar. 26, 1973, and now abandoned, the disclosure of which is expressly incorporated herein by reference.

FIELD OF THE INVENTION

This invention relates to a new and useful ultrasonic system for greatly improved combustion, emission control and fuel economy on internal combustion engines.

BACKGROUND OF THE INVENTION

Preliminarily, I wish to refer generally to the following U.S. Pat. Nos. 2,791,994; 3,284,762; 2,907,648; 3,155,141; 2,791,990; 1,939,302; 3,533,606; 3,016,233; 2,704,535; and British Pat. No. 723,797, as possibly being of interest. U.S. Pat. No. 2,907,648 relates to electrostrictive and magnetostrictive devices which apparently produce ultrasonic energy. The method of this invention is extremely efficient, practical and inexpensive. The system of this invention comprises a cylindrical piezoelectric ceramic transducer vibrating in the "hoop" mode or radial mode and being electrically driven by an oscillator and power amplifier. The transducer is in an "unloaded" condition (High Q); therefore, when the fuel strikes the surface it is immediately atomized or vaporized. It is to be expected that this invention will find rapid application in internal combustion engines to bring said engines into conformity with the increasing stringent standards for the control of exhaust pollution caused by such engines. This invention eliminates the need for expensive and undependable exhaust after-treatment devices by effectively dealing with the problem at the intake side of the engine.

SUMMARY OF THE INVENTION

This invention comprises a novel system for use on internal combustion engines comprising:

a. a cylindrical transducer of a length adapted to vibrate primarily in the hoop or radial mode, said transducer having inside and outside surfaces which are concentric cylinders, b. electrical means for powering said transducer in the hoop or radial mode, and c. means for impinging a stream of liquid internal combustion engine fuel into a vibrating cylindrical surface of said transducer at a rate whereby said fuel is effectively atomized or vaporized as it impinges.

It is an object of this invention to significantly reduce the amount of environmental abuse incident the use of vehicles powered by internal combustion engines.

More particularly, it is an object of this invention to provide a system which obviates the need for the use of aftertreatment devices for the exhaust produced by internal combustion engines.

Still further, it is a major object of this invention to provide a more efficient means of vaporizing or atomizing fuel at the intake side of the invention.

This invention also has as an objective, the provision of a fuel vaporizing or atomizing system that is operational for engines of all practical sizes and at all normal operating conditions.

These and other objects and advantages of this invention will be apparent from the foregoing discussion and the following more detailed description, as well as from the accompanying drawings.

DESCRIPTION OF THE PREFERRED EMBODIMENTS

Turning to the drawings.

Figure 1:
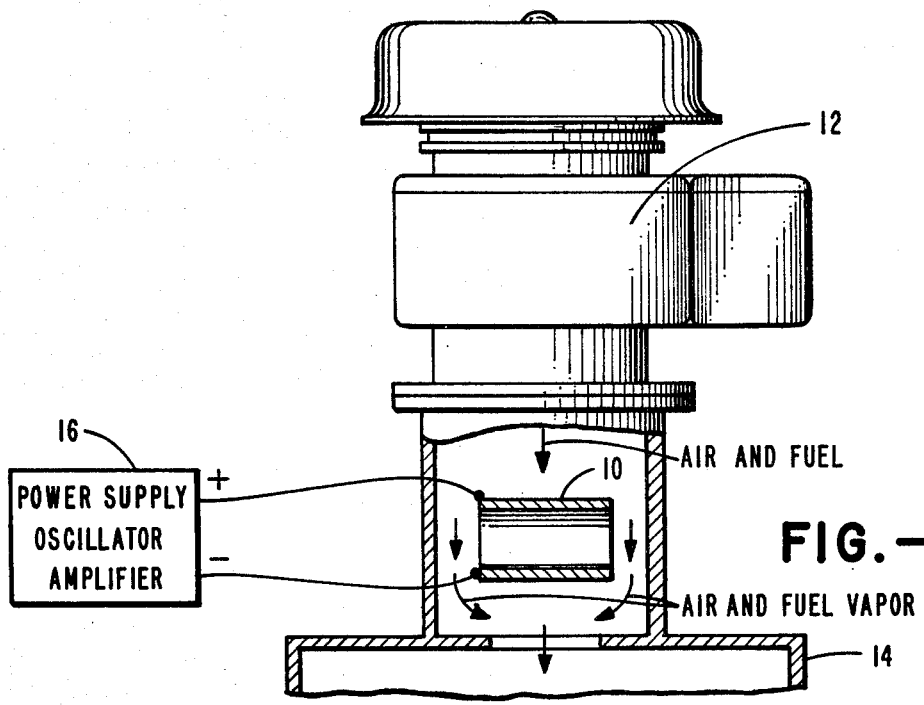
FIG. 1 shows in side and partial sectional view, one embodiment of the system of this invention.

Turning to the drawings in greater detail, in FIG. 1, the ceramic cylinder 10 is placed at right angles to the output of the carburetor 12 and intake manifold 14. Fuel and air leave the carburetor 12. The raw fuel strikes the surface of the vibrating piezoelectric cylinder 10 and the resulting vapor is swept through the intake manifold 14 and into the internal combustion engine (not shown). The cylinder 10 is driven by power supply 16 which is of generally conventional design and need not be described in detail here.

Figure 2:
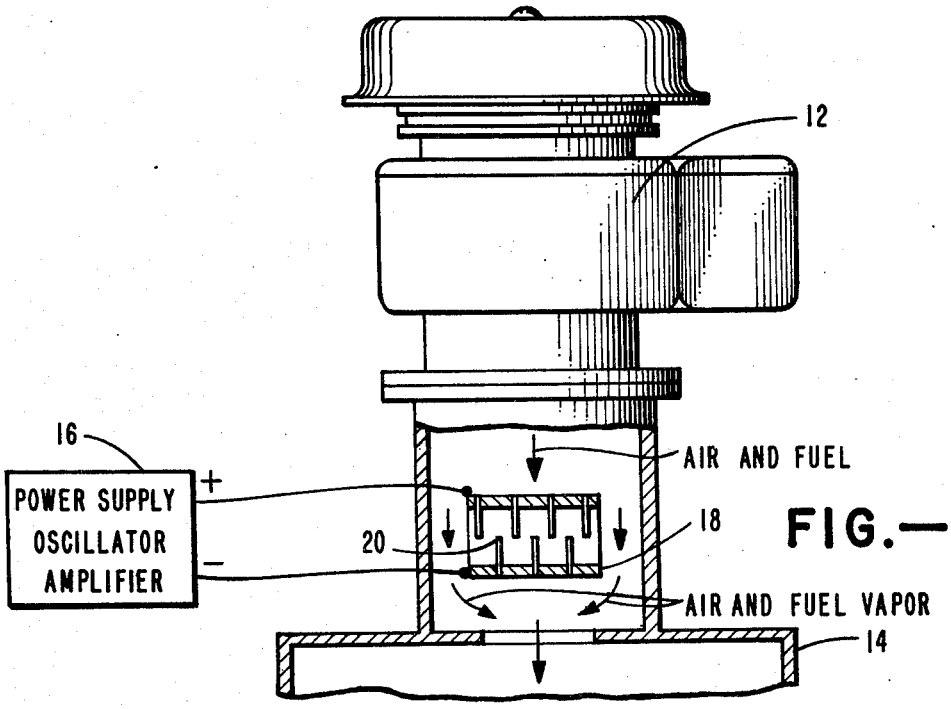
FIG. 2 shows an alternate embodiment of the system of FIG. 1.

In FIG. 2, the slotted ceramic cylinder 18 which is described in greater detail in U.S. Pat. No. 3,284,762 is placed at right angles to the output of the carburetor and intake manifold. This configuration allows the raw fuel to strike the transducer 18 on the outside diameter and the manifold vacuum pulls the fuel vapor and air through the slots 20, which in turn strike the inside diameter of the transducer to form an even greater vapor and the molecularized vapor is pulled into the engine and complete combustion takes place.

Figure 3:
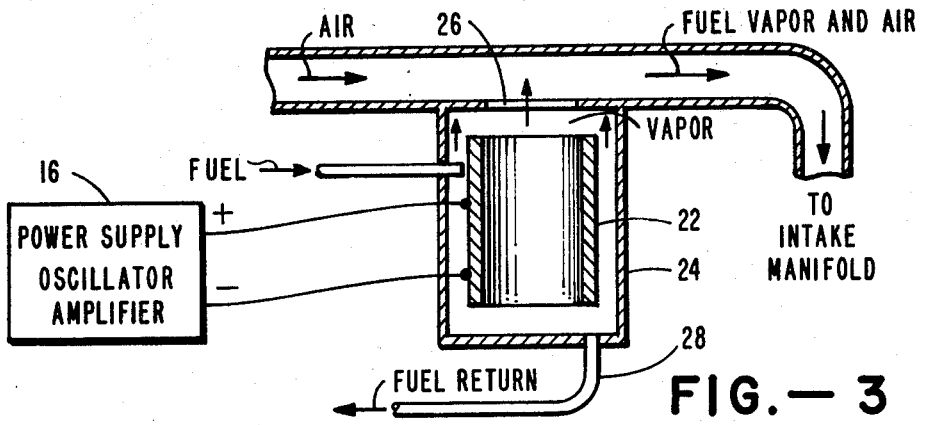
FIG. 3 shows a sectional view of another embodiment of this invention.

In the embodiment of FIG. 3, the purpose is to eliminate the carburetor entirely. The cylindrical ceramic transducer 22 is placed vertically in a chamber 24 that is sealed, except for the opening 26 at the top. There is a fuel return line 28 at the bottom of the chamber. The fuel is pumped directly at the side of the transducer 22 and is instantly vaporized. The vapor is swept into the air supply by the vacuum from the intake manifold and on into the engine.

Figure 4:
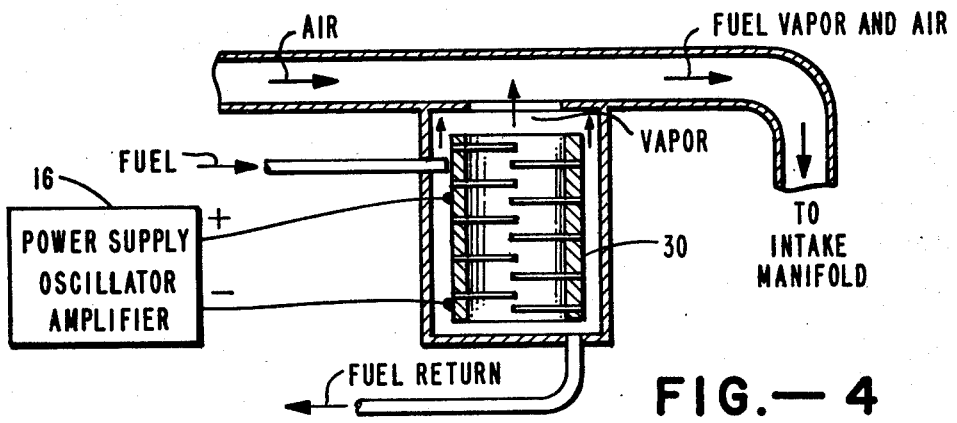
FIG. 4 shows an alternate embodiment of the system of FIG. 3.

In FIG. 4, no carburetor is used. The slotted ceramic cylinder 30 is placed vertically in a chamber that is sealed, except for the top, the fuel entrance and fuel return. The fuel is pumped directly to the side of the slotted tube and is immediately vaporized. Some of the fuel will be swept through the slots, will strike the inside diameter of the transducer, the fuel will be further vaporized and the resulting vapor swept into the air stream by the vacuum from the intake manifold.

Figure 5:
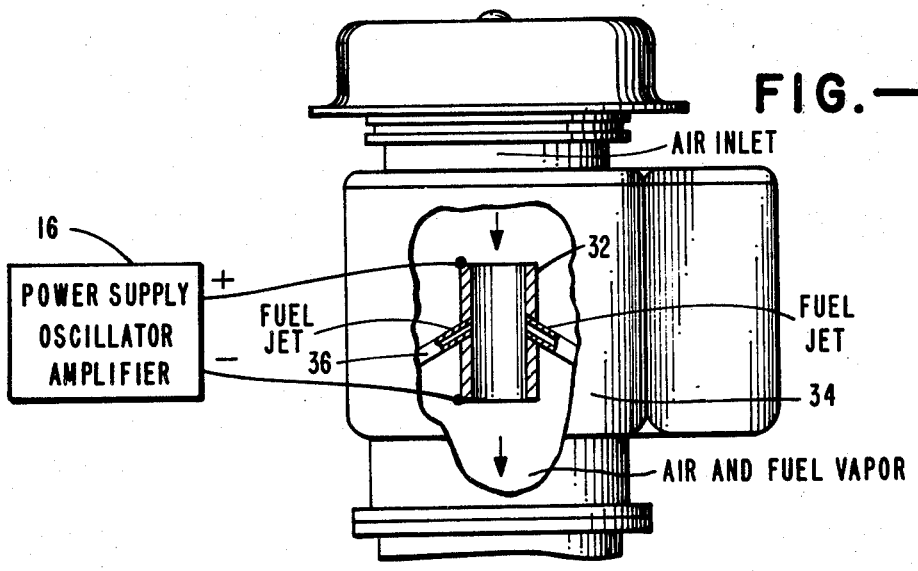
FIG. 5 shows a side and partial sectional view of still another embodiment of the present invention.

In the case of FIG. 5, the piezoelectric cylinder 32 is placed inside the carburetor 34, the fuel jets 36 direct their flow directly to the side of the transducer and the fuel is vaporized inside the carburetor. The fuel jets in the carburetor go up so gas is siphoned out, not dumped to flood the manifold.

The system of FIG. 5 can be modified by using the slotted tube of U.S. Pat. No. 3,284,762.

A plurality of piezoelectric cylinders can be used, depending on the size of the carburetor. The size and frequency of the transducer can be very flexible; e.g., the cylinders used in FIG. 1 had a hoop mode frequency of 20 kilo-hertz. The ceramic was 2.125 OD., 0.25 wall thickness and 1.5 inches long. The transducer was driven with 15 watts electrical power. The composition of the ceramic was modified lead zirconate-lead titanate polycrystalline material. The ceramic cylinder in FIG. 2 was 3 inches long, 2.125 O.D., and 0.125 wall thickness with three 0.060 wide slots on one side and two slots on the other. The resonant radial frequency was 21 kilo-hertz. The power used was 17 watts.

Lead wires were soldered to the silver surfaces on the ceramic, and the cylinder dipped in epoxy. The coat of epoxy was built up to approximately 0.020 of an inch on the O.D. and I.D. of the ceramic. The purpose of this build-up is two-fold, namely, to pre-stress the ceramic so it won't break under power and to insulate and prevent fire or shorting. The system works very well on fuels generally, including, gasoline, kerosene, jet fuel, and diesel fuel.

This system, using the cylindrical transducer in the hoop mode is suitable for use on all of the following engines: standard automobile internal combustion engines, diesel engines, motorcycles, jet aircraft, and wankel engine.

Results to date on a 6-cylinder Chrysler industrial engine (air compressor) indicated a 50 percent reduction in fuel consumption and the emission was primarily $CO_2$ and water. The transducer was driven at a frequency of 20 kilo-hertz. Another ceramic cylinder configuration was used, employing the slotted cylinder covered under U.S. Pat. No. 3,284,762. Excellent results were also obtained.

Having fully described the invention, it is intended that it be limited only by the scope of the following claims.

I claim:

1. In an internal combustion engine, the improvement wherein the fuel supply system includes:
   a. a cylindrical piezoelectric polycrystalline transducer of a length adapted to vibrate primarily in the hoop or radial mode, said transducer having inside and outside surfaces which are concentric cylinders,
   b. electrical means for uniformly vibrating said surfaces of said transducer primarily in the hoop or radial mode at its resonant frequency, and
   c. means for impinging a stream of liquid internal combustion engine fuel onto a vibrating cylindrical surface of said transducer at a rate whereby said fuel is immediately atomized or vaporized as it impinges and said transducer remains in an unloaded condition.

2. In an internal combustion engine, the improvement wherein the fuel supply system includes:
   a. a cylindrical piezoelectric polycrystalline transducer of a length adapted to vibrate primarily in the hoop or radial mode, said transducer having inside and outside surfaces which are concentric cylinders,
   b. electrical means for uniformly vibrating said surfaces of said transducer primarily in the hoop or radial mode at its resonant frequency,
   c. means for impinging a stream of liquid internal combustion engine fuel onto a vibrating cylindrical surface of said transducer at a rate whereby said fuel is immediately atomized or vaporized as it impinges and said transducer remains in an unloaded condition, and
   d. means for contacting a flow of air with said atomized or vaporized fuel.

3. A novel system for providing a combustible air-fuel vapor internal combustion mixture in an engine comprising:
   a. cylindrical piezoelectric polycrystalline transducer of a length adapted to vibrate primarily in the hoop or radial mode, said transducer having inside and outside surfaces which are concentric cylinders,
   b. electrical means for uniformly vibrating said surfaces of said transducer primarily in the hoop or radial mode at its resonant frequency,
   c. means for impinging a stream of liquid internal combustion engine fuel onto a vibrating cylindrical surface of said transducer at a rate whereby said fuel is immediately atomized or vaporized as it impinges and said transducer remains in an unloaded condition, and
   d. means for contacting a flow of air with said atomized or vaporized fuel.

4. The system of claim 3 wherein the cylindrical transducer is disposed at a right angle to the flow of air.

5. The system of claim 3 wherein the cylindrical transducer is disposed longitudinally with respect to the flow of air.

6. The system of claim 3 wherein said cylindrical transducer is vertically disposed, and said means for contacting a flow of air is positioned above said cylinder and is adapted to suck atomized or vaporized fuel formed by said cylinder upwardly into said means, said means discharging directly into an intake manifold.

7. The system of claim 6 wherein a liquid fuel return is provided in proximity to the bottom of said cylindrical transducer.

8. A novel system for providing a combustible air-fuel vapor mixture in an internal combustion engine comprising:
   a. a cylindrical piezoelectric polycrystalline transducer of a length adapted to vibrate primarily in the hoop or radial mode, said transducer having inside and outside surfaces which are concentric cylinders,
   b. electrical means for uniformly vibrating said surfaces of said transducer primarily in the hoop or radial mode at its resonant frequency, and
   c. means for impinging a stream of liquid internal combustion engine fuel onto a vibrating cylindrical surface of said transducer at a rate whereby said fuel is immediately atomized or vaporized as it impinges and said transducer remains in an unloaded condition.

9. The system of claim 8 wherein the cylindrical transducer is ceramic.

10. The system of claim 8 wherein the cylindrical transducer is slotted.

11. The system of claim 8 wherein the cylindrical transducer is disposed between a carburetor and the intake manifold.

12. The system of claim 8 wherein the cylindrical transducer is positioned within the carburetor.

13. The system of claim 8 wherein the cylindrical transducer has a hoop mode frequency of about 20 kilo-hertz.

14. The system of claim 8 wherein the cylindrical transducer comprises a polycrystalline lead zirconate-lead titanate.

15. The system of claim 8 wherein the fuel is gaseline.

16. The system of claim 8 wherein the fuel is vaporized or atomized on the exterior surface of said cylindrical transducer.

17. The system of claim 8 wherein the fuel is vaporized or atomized on both the interior and exterior surfaces of said cylindrical transducer.

* * * * *